US007983575B1

(12) United States Patent
Zona et al.

(10) Patent No.: US 7,983,575 B1
(45) Date of Patent: Jul. 19, 2011

(54) APPARATUS AND METHOD FOR DETERMINING PHOTORECEPTOR CHARGE TRANSPORT LAYER THICKNESS OF APPARATUS USING A SCOROTRON CHARGE DEVICE

(75) Inventors: Michael F. Zona, Holley, NY (US); Aaron Michael Burry, Ontario, NY (US); Eric S. Hamby, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/647,908

(22) Filed: Dec. 28, 2009

(51) Int. Cl.
*G03G 15/02* (2006.01)

(52) U.S. Cl. ..... 399/26

(58) Field of Classification Search ..... 399/26, 399/50, 172
See application file for complete search history.

(56) References Cited

U.S. PATENT DOCUMENTS 5,359,393 A * 10/1994 Folkins ..... 399/50
2002/0127027 A1* 9/2002 Kubota et al. ..... 399/55

FOREIGN PATENT DOCUMENTS

JP 2000089624 A * 3/2000

* cited by examiner

*Primary Examiner* — Constantine Hannaher
(74) *Attorney, Agent, or Firm* — Oliff & Berridge, PLC

(57) ABSTRACT

A photoreceptor charge transport layer thickness determining apparatus for a photoreceptor including a scorotron charge device having coronode wires and a scorotron grid positioned between the corona wires and the photoreceptor charge transport layer, the scorotron charge device being configured to charge the photoreceptor layer using corona discharge to generate ions directed to a surface of the photoreceptor charge transport layer. A first current measuring device measures a current supplied to the coronode wires and outputs a first current value, a second current measuring device measures a current being delivered to the scorotron grid and outputs a second current value, and a processor receives the first and second current values and determines a current delivered to the photoreceptor charge transport layer by subtracting the second current value from the first current value, and determines a thickness of the photoreceptor charge transport layer using the current value.

17 Claims, 5 Drawing Sheets

APPARATUS AND METHOD FOR DETERMINING PHOTORECEPTOR CHARGE TRANSPORT LAYER THICKNESS OF APPARATUS USING A SCOROTRON CHARGE DEVICE

BACKGROUND

Devices such as printers, copiers, and fax machines use a photoreceptor (also known as a photoconductor) having a photoreceptor charge transport layer. One type of photoreceptor is known as a photoreceptor drum (also know as a photoconductor drum). As the photoreceptor drum is used, the thickness of the photoreceptor charge transport layer is reduced and, at a certain thickness point, the photoreceptor charge transport layer fails. In view of this, manufacturers of photoreceptor drums generally provide a fixed interval setting to replace the photoreceptor drum in the device. This fixed setting is set by the manufacturer for an entire population of a particular type of photoreceptor drum and does not take into consideration the manner or environment in which a user actually uses the device having the photoreceptor drum. Replacing the photoreceptor drum at a fixed interval typically results in more frequent replacement of the photoreceptor drum than what is required for an individual use of the device.

Instead of replacing the photoreceptor drum at a fixed interval, it has been considered that in-situ determination of the photoreceptor charge transport layer thickness could be made and used to predict failure of that photoreceptor drum. Predicting failure of the photoreceptor charge transport layer on a photoreceptor by photoreceptor basis eliminates the need for replacing the photoreceptor drum at a predetermined interval. This enables a user to reduce the cost of operating a device having the photoreceptor drum by running each photoreceptor drum to a point at which the photoreceptor charge transport layer is just about to fail.

Some effort has been expended to enable in-situ determination of photoreceptor charge transport layer thickness for devices that use bias charged roll chargers. This effort is based on key characteristic behaviors of bias charged roll chargers, and in particular, the saturation of the photoreceptor voltage at the characteristic "knee" of the charge curve.

Many marking engines still use non-contact charging of the photoreceptor. One type of non-contact charging is scorotron charging, which uses corona discharge to generate ions that are directed to a surface of the photoreceptor charge transport layer. A scorotron usually includes coronode wires with a scorotron grid formed by a metal mesh or screen placed between the coronode wires and the surface of the photoreceptor charge transport layer. The scorotron grid is biased to a potential close to that desired at the surface of the photoreceptor charge transport layer. When the surface potential of the photoreceptor charge transport layer reaches the potential of the scorotron grid bias, the photoreceptor charging process ceases.

Unfortunately, the key characteristic behaviors of bias charged roll chargers are completely inapplicable for photoreceptor devices that use scorotron charging.

SUMMARY

The present disclosure exemplarily describes a photoreceptor that has a photoreceptor charge transport layer that is charged using a scorotron charge device, and apparatus for determining photoreceptor charge transport layer thickness. The thickness of the photoreceptor charge transport layer is used to predict life estimation of the photoreceptor.

In exemplary embodiments, there is provided a photoreceptor charge transport layer thickness determining apparatus, comprising a photoreceptor having the photoreceptor charge transport layer, a scorotron charge device including coronode wires, and a scorotron grid positioned between the coronode wires and the photoreceptor charge transport layer, the scorotron charge device being configured to charge the photoreceptor layer using corona discharge to generate ions directed to a surface of the photoreceptor charge transport layer. The apparatus can further include a first current measuring device that measures a current supplied to the coronode wires and outputs a first current value, a second current measuring device that measures a current being delivered to the scorotron grid and outputs a second current value, and a processor that receives the first and second current values, determines a current delivered to the photoreceptor charge transport layer by subtracting the second current value from the first current value, and determines a thickness of the photoreceptor charge transport layer using the current delivered to the photoreceptor charge transport layer.

In various exemplary embodiments, there is a method of determining thickness of a photoreceptor charge transport layer of a photoreceptor charged with a scorotron charge device including coronode wires and a scorotron grid positioned between the coronode wires and the photoreceptor charge transport layer. The method can include measuring a current supplied to the coronode wires and outputting a first current value, measuring a current delivered to the scorotron grid and outputting a second current value, determining a current delivered to the photoreceptor charge transport layer by subtracting the second current value from the first current value, and determining a thickness of the photoreceptor charge transport layer using the current delivered to the photoreceptor charge transport layer.

BRIEF DESCRIPTION OF THE DRAWINGS

Various exemplary embodiments are described in detail with reference to the following figures, wherein elements having the same reference numeral designations represent like elements throughout, and in which.

DETAILED DESCRIPTION OF EMBODIMENTS

Figure 1:
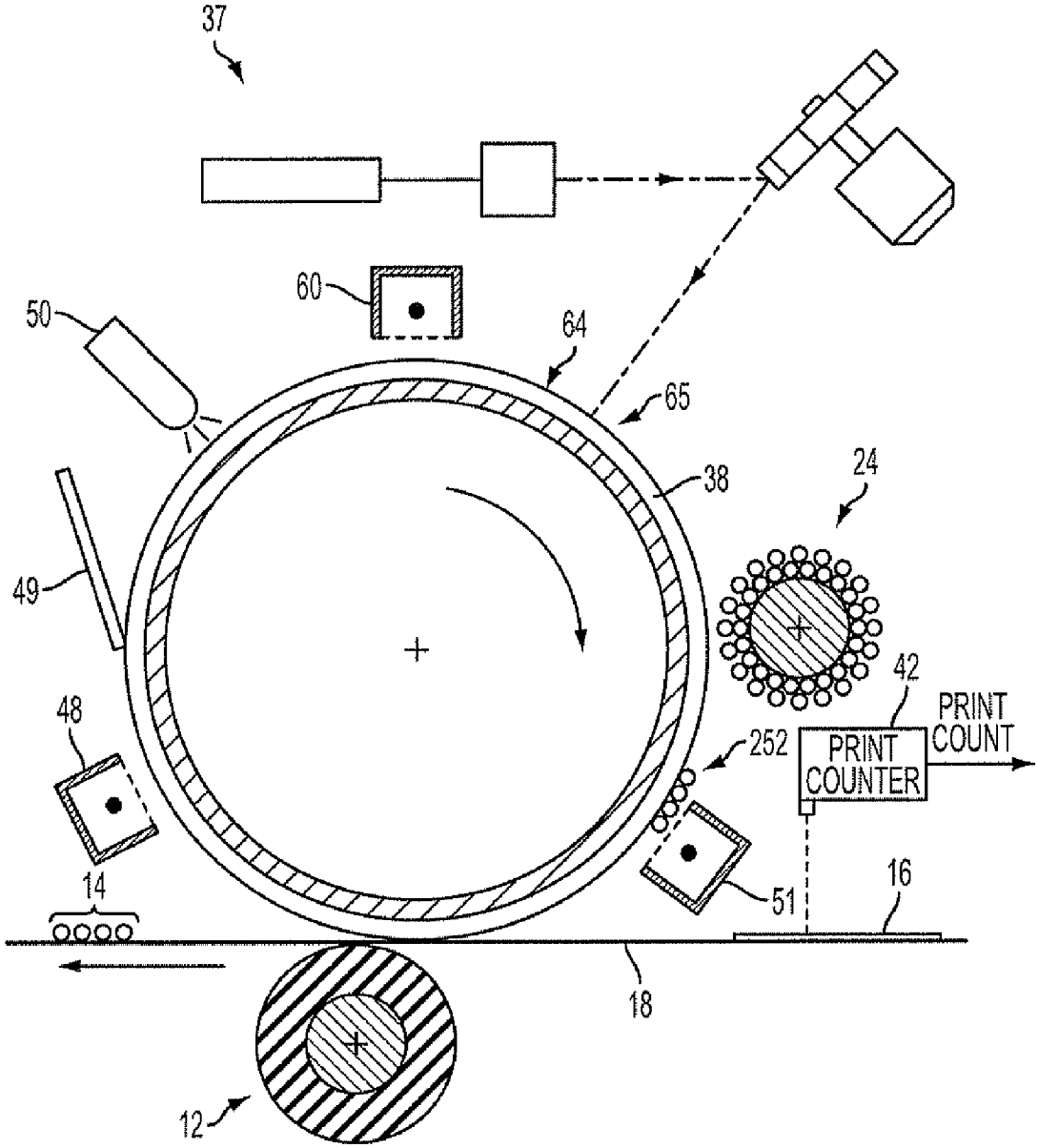
FIG. 1 is a is a schematic of an exemplary xerographic station of a xerographic printer with which the disclosed measuring apparatus may be used.

Referring to FIG. 1, there is shown a schematic view of an exemplary xerographic station of a printer, such as a copier or laser printer. Although the disclosure includes reference to the exemplary embodiments shown in the drawings, it should be understood that many alternate forms or embodiments exist. In addition, any suitable size, shape or type of elements or materials could be used.

As shown in FIG. 1, the exemplary xerographic station generally includes a photoreceptor drum 38 for transferring imaged toner 14 to a belt 18 as an intermediate transfer belt. While transferring imaged toner 14 to an intermediate transfer belt is shown and described, the disclosure is not so limited, as imaged toner can be transferred directly to a sheet-type medium 16.

Continuing to refer to FIG. 1, the exemplary xerographic station will be described, which can be for a black and white or multicolor copier or laser printer, or other similar type devices. To initiate an exemplary copying process, an original document is positioned on a raster input scanner (not shown) which captures the entire image from the original document which is then transmitted to a raster output scanner 37. For the exemplary xerographic station of FIG. 1, initially, a portion of the photoreceptor drum 38 passes through a charging station 60. At the charging station 60, a scorotron generates a charge voltage to charge a surface of the photoreceptor charge transport layer 64 of the photoreceptor drum 38 to a relatively high, substantially uniform voltage potential.

In the exemplary xerographic station of FIG. 1, one latent image is developed with one developer material 24, which is a type of toner of a particular color (e.g., black). While the exemplary embodiment has a single xerographic station with a single photoreceptor drum 38, the disclosure is not so limited, as there may be multiple xerographic stations to provide a multicolor copy. In this case, each xerographic station has a photoreceptor drum 38 for developing a latent image, corresponding to a specific color, with a developer material corresponding to that color (e.g., four xerographic stations, each having a photoreceptor drum for respectively developing one of a cyan developer material, a magenta developer material, a yellow developer material, and a black developer material).

As further shown in FIG. 1, the developed image 252 is charged with a pre-transfer subsystem 51, transferred to the belt 18 using biased transfer roll 12, and subsequently transferred to a copy sheet which is then fused thereto to form a single color copy. However, if there are multiple xerographic stations, each respective developed image 252 of a specific color would be sequentially transferred to the belt 18 in superimposed registration with one another, and subsequently transferred to the copy sheet to form a multicolored image on the copy sheet, which is then fused thereto to form a multicolor copy.

Alternatively, the respective developed image 252 could be transferred directly to sheet medium 16 which is then fused thereto to form a single color copy. While FIG. 1, shows the sheet medium 16 as exemplary being on belt 18 when the developed image 252 is transferred to the sheet medium 16, it is understood that the sheet medium 16 is not present on the belt 18 when the developed image 252 is transferred to the belt 18 as an intermediate transfer belt. Similarly, if there are multiple xerographic stations, each respective developed image 252 would be sequentially transferred to the sheet medium 16 in superimposed registration with one another to form a multicolored image on the sheet medium which is then fused thereto to form a multicolor copy.

After the develop image 252 is transferred, the photoreceptor drum is cleaned with the use of a pre-clean subsystem 48, a clean subsystem 49 and a erase lamp 50. If there multiple xerographic stations, each photoreceptor drum would be subjected to a similar cleaning. A count of the number of printed sheets is made by a print counter 42 using, for example, a photocell to determine when a sheet is present. While the exemplary xerographic station of FIG. 1 shows print counter 42 positioned to count a sheet medium 16 being fed to the photoreceptor drum 38, the disclosure is not so limited, as the print counter can be positioned to count a sheet medium being fed from the photoreceptor drum 38, count a sheet medium near a position at which the image on the sheet medium is fused, or at other positions.

The foregoing description should be sufficient to illustrate the general operation of the exemplary xerographic station incorporating the features of the present disclosure. As described, the exemplary xerographic station may be part of a printer, such as a copier or laser printer devices, or part of other similar type devices or systems.

Figure 2:
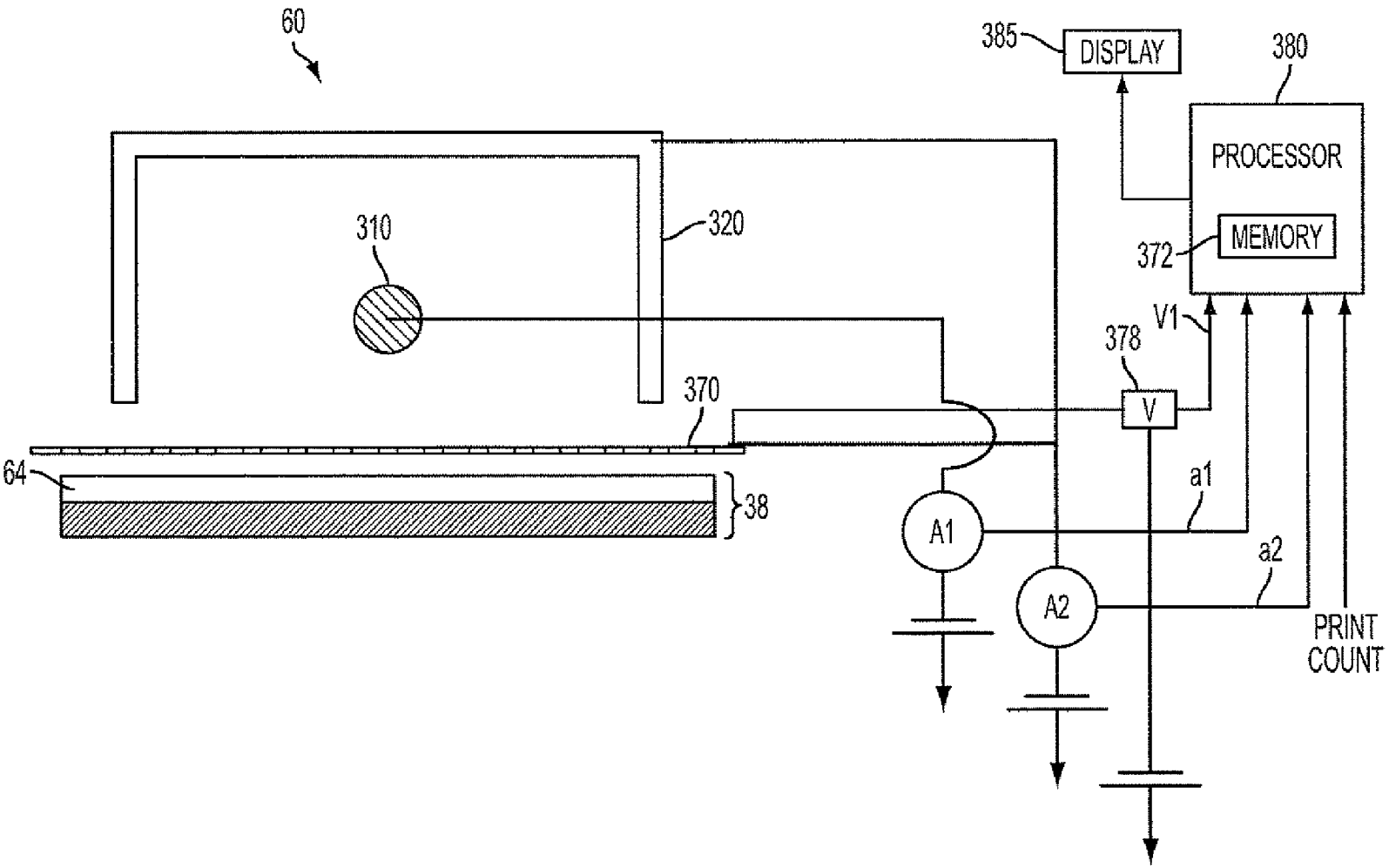
FIG. 2 is a schematic of exemplary measuring apparatus for determining photoreceptor charge transport layer thickness.

Referring to FIG. 2, an exemplary charging station 60 is shown. The exemplary charging station 60 uses corona discharge to generate ions that are directed to the surface of the photoreceptor's charge transport layer 64 and includes coronode wires 310, a scorotron shield 320 (also known as a charger case) covering the coronode wires 310, and a scorotron grid 370. The scorotron grid 370 includes a plurality of wires having a diameter larger than a diameter of the coronode wires or a screened metal mesh 310. In the exemplary charging station 60, the scorotron shield 320 is an electrically conducting box member where an axial direction of the coronode wires 310 is a direction of a length of the scorotron shield 320 and a surface thereof, facing the photoreceptor drum 38, is open. The scorotron grid 370 is positioned between the coronode wires 310 and the surface of the photoreceptor charge transport layer 64 so as to face the open surface of the scorotron shield 320.

To charge the surface of the photoreceptor charge transport layer 64, bias voltages are applied to the scorotron grid 370, the coronode wires 310, and the scorotron shield 320. The bias voltage applied to the scorotron grid 370 is a potential close to that desired at the surface of the photoreceptor charge transport layer 64 and is different from the bias voltage applied to the coronode wires 310. In the present exemplary embodiment, the bias voltage applied to the scorotron grid electrode 370 is the same as the bias voltage applied to the scorotron shield 320. However, in other exemplary embodiments, the bias voltage applied to the scorotron grid electrode 370 can be different from the bias voltage applied to the scorotron shield 320. When the surface potential of the photoreceptor charge transport layer 64 reaches the potential of the scorotron grid bias, the photoreceptor charging process ceases.

Continuing to refer to FIG. 2, the exemplary charging station 60 also includes ammeter A1 connected to coronode wires 310, and ammeter A2 connected to the scorotron grid 370 and the scorotron shield 320. The ammeter A1 provides a current value a1 of the amount of current supplied to the coronode wires 310, and the ammeter A2 provides a current value a2 of the amount of current being delivered to the scorotron shield 320 and to the scorotron grid electrode 370. A voltage detecting device 378 is connected to the scorotron grid 370 and provides a voltage value v1 of the amount of voltage at the scorotron grid 370. The current values a1 and a2, and the voltage value v1 are supplied to a processor 380 and stored in a memory 372. The processor 380 is generally in the device that uses the photoreceptor. A display 385 is connected to the processor 380.

The thickness of the photoreceptor charge transport layer 64 can be determined by using the current ($I_{dynamic}$) delivered to photoreceptor charge transport layer 64. The current ($I_{dynamic}$) is determined by measuring the current a1 supplied to the coronode wires 310 and measuring the current a2 supplied to the scorotron grid 370 during charging of the photoreceptor charge transport layer 64, storing the values a1 and a2 in memory 372, and then subtracting the value of a2 from the value of a1.

Once the current ($I_{dynamic}$) is determined, the processor 380 then determines thickness of the photoreceptor charge transport layer 64 for the current ($I_{dynamic}$) using the following equations:

$$I_{dynamic}=Cv(V_{int}-V_{initial})(1-e^{-S/Cv}) \quad (1)$$

$$C=\epsilon_0 k/d\times 10^6, \text{ where} \quad (2)$$

d=the thickness of the photoreceptor charge transport layer that is to be determined, k=the dielectric constant of the photoreceptor charge transport layer (a known constant), $\epsilon_0$=permittivity of free space (a constant equal to 8.85e−12), C=capacitance per unit area of the photoreceptor charge transport layer in uf/meter$^2$ (to be determined), v=velocity of the surface of the photoreceptor charge transport layer in meters/second (a known constant), $V_{int}$=intercept voltage of the scorotron charge device (measured grid voltage v1), $V_{initial}$=voltage of the photoreceptor layer surface entering prior to charging (assumed fixed voltage), and S=slope of the scorotron charge device (a known constant).

The processor 380 stores the measured grid voltage (v1) and the known values of k, $\epsilon_0$, v, $V_{int}$, $V_{initial}$, and S in the memory 372. Once $I_{dynamic}$ is determined by subtracting a2 from a1, the processor 380 uses equation (1) and the stored values to determine the capacitance C of the photoreceptor charge transport layer. After the capacitance C is determined, the processor 380 uses the equation (2) and the stored values to determined the thickness d of the photoreceptor charge transport layer.

Figure 3:
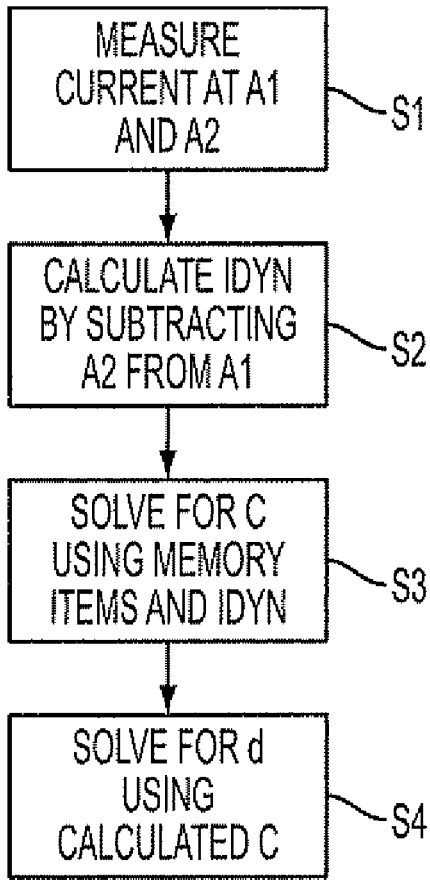
FIG. 3 is a flow diagram of an exemplary method of determining photoreceptor charge transport layer thickness.

FIG. 3 is a flow diagram showing the steps S1 to S4 for solving for the thickness d of the photoreceptor charge transport layer using the known values of k, $\epsilon_0$, v, $V_{int}$, $V_{initial}$, and S. At step S1, current a1 is measured by ammeter A1 and current a2 is measured by ammeter A2. At step S2, the current value a2 measured by ammeter A2 is subtracted from the current value a1 measured by ammeter A1 to provide the current ($I_{dynamic}$) delivered to photoreceptor charge transport layer. At step S3, the current ($I_{dynamic}$) is used in equation (1) to determine capacitance C per unit area of the photoreceptor charge transport layer. After determining C using equation (1), the thickness d of the photoreceptor charge transport layer is determined at step S4 by using the determined value C in equation (2).

When solving for the thickness d using equations (1) and (2), the following assumptions are usually made: (i) the initial voltage is the residual voltage of the photoreceptor charge transport layer and does not change over time, and is not effected by $I_{dynamic}$, (ii) the intercept voltage $V_{int}$ is the applied grid voltage v1 and does not change over time, and is not effected by environment, print count, area coverage of printing, etc., and (iii) the slope S of the charge device is constant over the life of the device.

Figure 4:
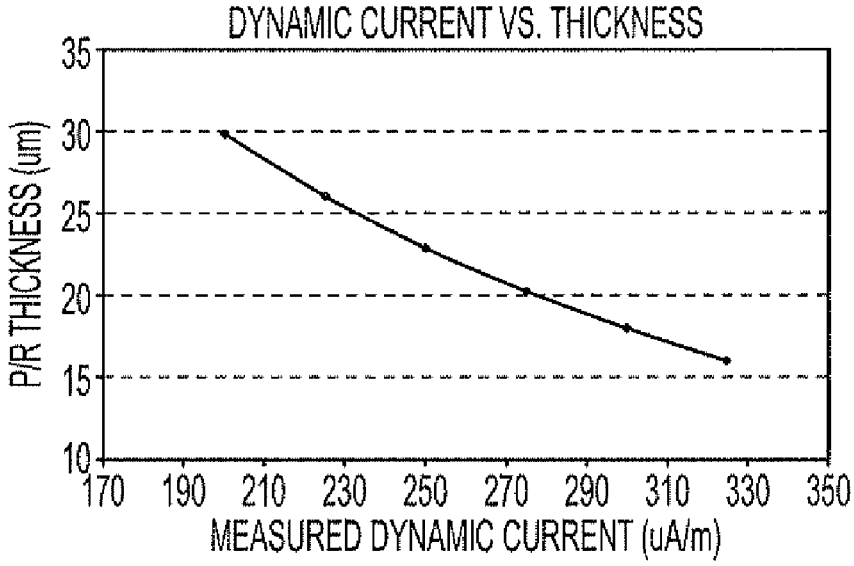
FIG. 4 is an exemplary graph plotting dynamic current vs. thickness.

FIG. 4 is an exemplary graph plotting dynamic current vs. thickness, and shows calculated thickness for six measured values of $I_{dynamic}$ (at the black dots). For the measured values of $I_{dynamic}$ of the exemplary graph of FIG. 4, S=1.2 μA/m-v, v=362 mm/sec, $V_{int}$=grid voltage=−600 volts, $V_{initial}$=0 volts, k=3.2, and the photoreceptor charge transport layer was presumed to fail when the thickness reaches 15 μm. The line was drawn by connecting the six measured values of $I_{dynamic}$.

Figure 5:
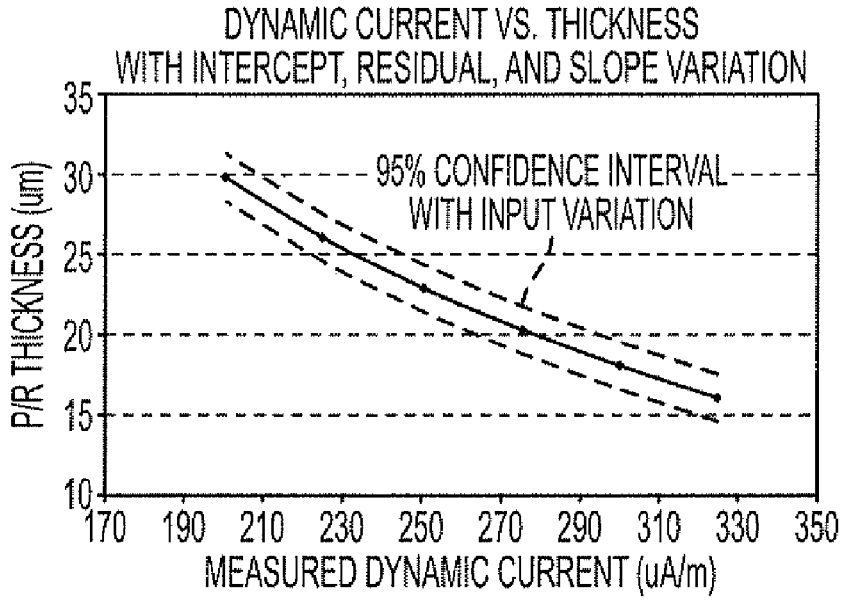
FIG. 5 is another exemplary graph plotting dynamic current vs. thickness.

However, in typical device operations, the three assumptions (i) to (iii) maybe risky to assume. In fact, the residual voltage can change with environment, print count, and area coverage of printing. Further, as the charge device gets dirty, the slope and intercept can change. This can add error in the calculation of the thickness of the photoreceptor charge transport layer. In typical device operations, (i) the residual voltage can vary from 0 to 50 volts, (ii) the intercept voltage of the charge device can vary +/−15 volts, and (iii) the slope can vary +/−0.5 μA/m-v. Using these variations on the inputs to the dynamic current formula, 100,000 simulations were run and it was found that the resulting dynamic current can have a standard deviation of 6.5 μA/m. Even with this amount of variability in the inputs, the determined thickness, based on the variability in dynamic current, is +/−1.5 microns with 95% confidence. FIG. 5 is another exemplary graph plotting dynamic current vs. thickness showing the 95% confidence interval with the input variation.

If the thickness is calculated at some interval over the useable life of the photoreceptor charge transport layer, a plot can be made and used to predict when the photoreceptor device might require replacing (assuming a customer's environment and use pattern do not change dramatically).

Figure 6:
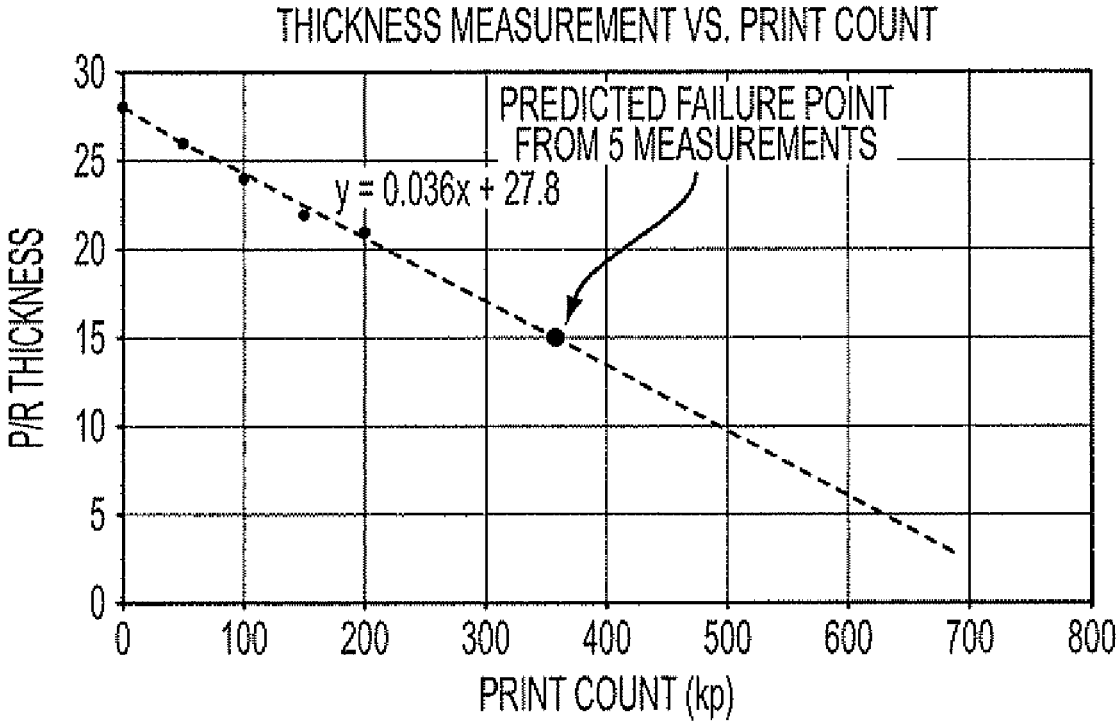
FIG. 6 is an exemplary graph plotting thickness vs. print count.

FIG. 6 is an exemplary graph plotting thickness vs. print count and shows how an estimated failure count can be predicted in order to (1) alert the customer to order a new photoreceptor drum since the current photoreceptor drum is predicted to be at the end of its useable life, (2) have the service engineer replace the photoreceptor drum if the actual print count is near the predicted failure count, and (3) diagnose reasons for non-uniform halftones and rule out the thickness as the reason for the non-uniformity.

The exemplary graph of FIG. 6 shows thickness determined beginning from a time that the photoreceptor drum is placed in service (0 print count) and at four equal 50 k print count intervals (at print count of 50 k, 100 k, 150 k, 200 k). These five points are used to plot the dotted line in FIG. 6 using linear regression. As indicated in the exemplary graph of FIG. 6, the photoreceptor charge transport layer is considered to fail when the thickness reaches 15 μm. The exemplary graph of FIG. 6 shows that the print count is predicted to be about 355 k when the thickness of the photoreceptor charge transport layer is predicted to reach 15 μm. Display of a value or values corresponding to the predicted print count can be made on the display 385 of FIG. 2 to alert the user as to when the photoreceptor charge transport layer is predicted to fail (e.g., number of sheets remaining to be printed until failure). By continuing to determine the thickness of the photoreceptor charge transport layer at regular intervals after the 200 k print count, a more refined prediction can be made as to when the photoreceptor charge transport layer will fail. While the exemplary graph of FIG. 6 shows four 50 k Print Count intervals at which thickness is determine after initially determining thickness when the photoreceptor drum is placed in service, the disclosure is not so limited, as thickness can be determined at other print count intervals without departing from the broader aspects of the disclosure.

While the present disclosure has been described in conjunction with exemplary embodiments, these embodiments should be viewed as illustrative, and not limiting. It will be appreciated that various of the above-disclosed and other features and functions, or alternatives thereof, may be desirably combined into many other different systems or applications, Also, various presently unforeseen or unanticipated alternatives, modifications, variations, or improvements therein may be subsequently made by those skilled in the art and are also intended to be encompassed.

What is claimed is:

1. A photoreceptor charge transport layer thickness determining apparatus, comprising:

a photoreceptor having the photoreceptor charge transport layer;

a scorotron charge device including coronode wires and a scorotron grid positioned between the coronode wires and the photoreceptor charge transport layer, the scorotron charge device being configured to charge the photoreceptor charge transport layer using corona discharge to generate ions directed to a surface of the photoreceptor charge transport layer;

a first current measuring device that measures a current supplied to the coronode wires and outputs a first current value;

a second current measuring device that measures a current supplied from the scorotron grid and outputs a second current value;

a processor that receives the first and second current values and determines a current ($I_{dynamic}$) delivered to the photoreceptor charge transport layer by subtracting the second current value from the first current value, and determines a thickness of the photoreceptor charge transport layer based on the current value ($I_{dynamic}$); and a voltage measuring device that measures voltage of the scorotron grid and outputs a voltage value to the processor, wherein the processor determines the thickness of the photoreceptor charge transport layer using:

$$I_{dynamic}=Cv(V_{int}-V_{initial})(1-e^{-S/Cv})$$

$$C=\epsilon_0 k/d\times 10^6, \text{ where}$$

d=the thickness of the photoreceptor charge transport layer that is to be determined, k=the dielectric constant of the photoreceptor charge transport layer (a known constant), $\epsilon_0$=permittivity of free space (8.85e—12), C=capacitance per unit area of the photoreceptor layer in μf/meter$^2$ (to be determined), v=velocity of the surface of the photoreceptor charge transport layer in meters/second (a known constant), $V_{int}$=intercept voltage of the scorotron charge device (the measured voltage value), $V_{initial}$=voltage of the entering surface of the photoreceptor charge transport layer prior to charging (assumed to be 0 volts), and S=slope of the scorotron charge device (a known constant).

2. A photoreceptor charge transport layer thickness determining apparatus, comprising a photoreceptor having the photoreceptor charge transport layer;

a scorotron charge device including coronode wires and a scorotron grid positioned between the coronode wires and the photoreceptor charge transport layer, the scorotron charge device being configured to charge the photoreceptor charge transport layer using corona discharge to generate ions directed to a surface of the photoreceptor charge transport layer;

a first current measuring device that measures a current supplied to the coronode wires and outputs a first current value;

a second current measuring device that measures a current supplied from the scorotron grid and outputs a second current value; and a processor that receives the first and second current values and determines a current ($I_{dynamic}$) delivered to the photoreceptor charge transport layer by subtracting the second current value from the first current value, and determines a thickness of the photoreceptor charge transport layer based on the current value ($I_{dynamic}$), wherein a developed toner image is formed on the charged photoreceptor charge transport layer for transfer to a sheet medium, the photoreceptor charge transport layer thickness measuring apparatus further comprising:

an counting device that counts a number of sheet medium to which any developed toner image is transferred beginning from a first use of the photoreceptor, and outputs a print count; and a failure prediction unit that receives a plurality of determined thicknesses of the photoreceptor charge transport layer, each determined thickness being made at a certain print count from each other, and predicts a failure count at which the photoreceptor needs to be replaced, the failure count representing a total print count at a time the thickness of the photoreceptor charge transport layer reaches a predetermined failure thickness.

3. The photoreceptor charge transport layer thickness determining apparatus according to claim 2, wherein a first determined thickness of the plurality of determined thicknesses of the photoreceptor charge transport layer is made at the first use of the photoreceptor.

4. The photoreceptor charge transport layer thickness determining apparatus according to claim 3, further comprising a display device that displays a value corresponding to the predicted failure count.

5. The photoreceptor charge transport layer thickness determining apparatus according to claim 3, wherein the failure prediction unit uses linear regression to predict the failure count.

6. The photoreceptor charge transport layer thickness determining apparatus according to claim 5, further comprising a display device that displays a value corresponding to the predicted failure count.

7. A method of determining thickness of a photoreceptor charge transport layer of a photoreceptor charged with a scorotron charge device including coronode wires and a scorotron grid positioned between the coronode wires and the photoreceptor charge transport layer, the method comprising:

measuring a current supplied to the coronode wires and outputting a first current value;

measuring a current from the scorotron grid and outputting a second current value;

determining a current ($I_{dynamic}$) delivered to the photoreceptor charge transport layer by subtracting the second current value from the first current value; and determining a thickness of the photoreceptor charge transport layer based on the current value ($I_{dynamic}$), wherein the thickness of the photoreceptor charge transport layer is determined using:

$$I_{dynamic}=Cv(V_{int}-V_{initial})(1-e^{-S/Cv})$$

$$C=\epsilon_0 k/d\times 10^6, \text{ to determine thickness, where}$$

d=the thickness of the photoreceptor charge transport layer that is to be determined, k=the dielectric constant of the photoreceptor charge transport layer (a known constant), $\epsilon_0$=permittivity of free space (8.85e−12), C=capacitance per unit area of the photoreceptor layer in μf/meter$^2$ (to be determined)=velocity of the surface of the photoreceptor charge transport layer in meters/second (a known constant), $V_{int}$=intercept voltage of the scorotron charge device (the measured voltage value), $V_{initial}$=voltage of the entering surface of the photoreceptor charge transport layer prior to charging (assumed to be 0 volts), and S=slope of the scorotron charge device (a known constant).

8. A method of determining thickness of a photoreceptor charge transport layer of a photoreceptor charged with a scorotron charge device including coronode wires and a scorotron grid positioned between the coronode wires and the photoreceptor charge transport layer, the method comprising:

measuring a current supplied to the coronode wires and outputting a first current value;

measuring a current from the scorotron grid and outputting a second current value;

determining a current ($I_{dynamic}$) delivered to the photoreceptor charge transport layer by subtracting the second current value from the first current value; and determining a thickness of the photoreceptor charge transport layer based on the current value ($I_{dynamic}$), wherein a developed toner image is formed on the charged photoreceptor charge transport layer for transfer to a sheet medium, the method further comprising:

counting a number of sheet medium to which any developed toner image is transferred beginning from a first use of the photoreceptor, and outputting a print count; and predicting a failure count at which the photoreceptor needs to be replaced using a plurality of determined thicknesses of the photoreceptor charge transport layer, each determined thickness being made at a certain print count from each other, and the failure count representing a total print count at a time the thickness of the photoreceptor charge transport layer reaches a predetermined failure thickness.

9. The method according to claim 8, further comprising:

determining a first determined thickness of the plurality of determined thicknesses of the photoreceptor charge transport layer at the first use of the photoreceptor.

10. The method according to claim 9, further comprising:

displaying a value corresponding to the predicted failure count.

11. The method according to claim 9, wherein predicting a failure count at which the photoreceptor needs to be replaced includes using linear regression to predict the failure count.

12. The method according to claim 11, further comprising:

displaying a value corresponding to the predicted failure count.

13. A xerographic device including a photoreceptor charge transport layer thickness determining apparatus comprising:

a photoreceptor having the photoreceptor charge transport layer;

a scorotron charge device including coronode wires and a scorotron grid positioned between the coronode wires and the photoreceptor charge transport layer, the scorotron charge device being configured to charge the photoreceptor charge transport layer using corona discharge to generate ions directed to a surface of the photoreceptor charge transport layer;

a first current measuring device that measures a current supplied to the coronode wires and outputs a first current value;

a second current measuring device that measures a current supplied from the scorotron grid and outputs a second current value;

a processor that receives the first and second current values and determines a current ($I_{dynamic}$) delivered to the photoreceptor charge transport layer by subtracting the second current value from the first current value, and determines a thickness of the photoreceptor charge transport layer based on the current value ($I_{dynamic}$); and a voltage measuring device that measures voltage of the scorotron grid and outputs a voltage value to the processor, wherein the processor determines the thickness of the photoreceptor charge transport layer using:

$$I_{dynamic}=Cv(V_{int}-V_{initial})(1-e^{-S/Cv})$$

$$C=\epsilon_0 k/d\times 10^6, \text{ where}$$

d=the thickness of the photoreceptor charge transport layer that is to be determined, k=the dielectric constant of the photoreceptor charge transport layer (a known constant), $\epsilon_0$=permittivity of free space (8.85e−12), C=capacitance per unit area of the photoreceptor layer in μf/meter$^2$ (to be determined), v=velocity of the surface of the photoreceptor charge transport layer in meters/second (a known constant), $V_{int}$=intercept voltage of the scorotron charge device (the measured voltage value), $V_{initial}$=voltage of the entering surface of the photoreceptor charge transport layer prior to charging (assumed to be 0 volts), and S=slope of the scorotron charge device (a known constant).

14. A xerographic device including a photoreceptor charge transport layer thickness determining apparatus comprising:

a photoreceptor having the photoreceptor charge transport layer;

a scorotron charge device including coronode wires and a scorotron grid positioned between the coronode wires and the photoreceptor charge transport layer, the scorotron charge device being configured to charge the photoreceptor charge transport layer using corona discharge to generate ions directed to a surface of the photoreceptor charge transport layer;

a first current measuring device that measures a current supplied to the coronode wires and outputs a first current value;

a second current measuring device that measures a current supplied from the scorotron grid and outputs a second current value; and a processor that receives the first and second current values and determines a current ($I_{dynamic}$) delivered to the photoreceptor charge transport layer by subtracting the second current value from the first current value, and determines a thickness of the photoreceptor charge transport layer based on the current value ($I_{dynamic}$), wherein a developed toner image is formed on the charged photoreceptor charge transport layer for transfer to a sheet medium, the photoreceptor charge transport layer thickness measuring apparatus further comprising:

an counting device that counts a number of sheet medium to which any developed toner image is transferred beginning from a first use of the photoreceptor, and outputs a print count; and a failure prediction unit that receives a plurality of determined thicknesses of the photoreceptor charge transport layer, each determined thickness being made at a certain print count from each other, and predicts a failure count at which the photoreceptor needs to be replaced, the failure count representing a total print count at a time the thickness of the photoreceptor charge transport layer reaches a predetermined failure thickness.

15. The xerographic device according to claim 14, wherein a first determined thickness of the plurality of determined thicknesses of the photoreceptor charge transport layer is made at the first use of the photoreceptor.

16. The xerographic device according to claim 15, further comprising a display device that displays a value corresponding to the predicted failure count.

17. The xerographic device according to claim 15, wherein the failure prediction unit uses linear regression to predict the failure count.

* * * * *